US010163557B2

(12) United States Patent
Lambert et al.

(10) Patent No.: US 10,163,557 B2
(45) Date of Patent: Dec. 25, 2018

(54) HELICAL PLATED THROUGH-HOLE PACKAGE INDUCTOR

(71) Applicant: Intel Corporation, Santa Clara, CA (US)

(72) Inventors: William J. Lambert, Chandler, AZ (US); Mihir K Roy, Chandler, AZ (US); Mathew J Manusharow, Phoenix, AZ (US); Yikang Deng, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/973,115

(22) Filed: Dec. 17, 2015

(65) Prior Publication Data

US 2017/0178786 A1 Jun. 22, 2017

(51) Int. Cl.

| | |
|---|---|
| ***H01F 5/00*** | (2006.01) |
| ***H01F 27/28*** | (2006.01) |
| ***C25D 5/16*** | (2006.01) |
| ***C25D 5/48*** | (2006.01) |
| ***C25D 7/00*** | (2006.01) |
| ***H01F 27/255*** | (2006.01) |
| ***H01F 41/02*** | (2006.01) |
| ***H01F 41/04*** | (2006.01) |
| ***H01F 17/00*** | (2006.01) |

(52) U.S. Cl.

CPC ..... *H01F 27/2804* (2013.01); *C25D 5/16* (2013.01); *C25D 5/48* (2013.01); *C25D 7/00* (2013.01); *H01F 17/0013* (2013.01); *H01F 17/0033* (2013.01); *H01F 27/255* (2013.01); *H01F 41/0206* (2013.01); *H01F 41/041* (2013.01); *H01F 41/046* (2013.01); *H01F 2017/002* (2013.01); *H01F 2027/2809* (2013.01)

(58) Field of Classification Search

CPC ..... H01F 27/2804; H01F 27/24; H01F 2027/2809; H01F 27/255; H01F 41/0206; H01F 41/041; C25D 5/16; C25D 5/48

USPC ..... 336/200, 232, 178, 83, 192

See application file for complete search history.

(56) References Cited

U.S. PATENT DOCUMENTS 3,509,270 A * 4/1970 Yorgensen ..... H01R 4/4872 174/266

6,507,262 B1 * 1/2003 Otte ..... H01F 1/15308 336/213

(Continued)

OTHER PUBLICATIONS

Google NPL "Buck converter".*

(Continued)

*Primary Examiner* — Kazi Hossain

(74) *Attorney, Agent, or Firm* — Schwegman Lundberg & Woessner, P.A.

(57) ABSTRACT

Devices and methods including a though-hole inductor for an electronic package are shown herein. Examples of the through-hole inductor include a substrate including at least one substrate layer. Each substrate layer including a dielectric layer having a first surface and a second surface. An aperture included in the dielectric layer is located from the first surface to the second surface. The aperture includes an aperture wall from the first surface to the second surface. A conductive layer is deposited on the first surface, second surface, and the aperture wall. At least one coil is cut from the conductive layer and located on the aperture wall.

9 Claims, 4 Drawing Sheets

(56) References Cited

U.S. PATENT DOCUMENTS

| | | | | |
|---|---|---|---|---|
| 8,597,979 | B1 * | 12/2013 | Burgyan | H01L 23/3121 257/686 |
| 2002/0022110 | A1 * | 2/2002 | Barr | H05K 1/115 428/137 |
| 2003/0011458 | A1 | 1/2003 | Nuytkens et al. | |
| 2004/0124961 | A1 * | 7/2004 | Aoyagi | H01F 17/0033 336/200 |
| 2007/0090911 | A1 | 4/2007 | Lee | |
| 2008/0186123 | A1 | 8/2008 | Wei et al. | |
| 2009/0224863 | A1 | 9/2009 | Mano et al. | |
| 2011/0050334 | A1 * | 3/2011 | Pan | H01L 23/642 327/564 |
| 2014/0002223 | A1 * | 1/2014 | Sainz | |
| 2014/0104288 | A1 * | 4/2014 | Shenoy | G09G 5/00 345/531 |
| 2014/0306673 | A1 * | 10/2014 | Le | H02M 3/156 323/266 |
| 2015/0177823 | A1 * | 6/2015 | Maiyuran | G06F 1/324 713/320 |
| 2015/0302975 | A1 | 10/2015 | Qi et al. | |
| 2017/0063229 | A1 * | 3/2017 | Powell | G05F 1/59 |

OTHER PUBLICATIONS

Scouras, Ismini, "UC Berkeley Scientists Advance On-Chip Inductor Technology", EE Times, designlines Wireless & Networking. [Online]. Retrieved from the Internet: <URL: http://www.eetimes.com/document.asp?doc_id=1321523>.

"International Application Serial No. PCT/US2016/063081, International Search Report dated Mar. 9, 2017", 3 pgs.

"International Application Serial No. PCT/US2016/063081, Written Opinion dated Mar. 9, 2017", 9 pgs.

* cited by examiner

HELICAL PLATED THROUGH-HOLE PACKAGE INDUCTOR

TECHNICAL FIELD

This document pertains generally, but not by way of limitation, to electronic packages, such as electronic packages including inductive elements.

BACKGROUND

Electronic packages, such as integrated circuit packages can include an inductor. The inductor can be used in a circuit to reduce or increase the voltage of a power supply to an operating voltage of the integrated circuit. Voltage regulation components can be included in the integrated circuit package, for instance, increase the power efficiency, or reduce the cost of the integrated circuit as well as reduce the space occupied by the voltage regulator. Some electronics packages include inductors on the bottom of the package (e.g., the bottom buildup layers of a substrate) for voltage regulation. The surface area of the package can be limited as there is demand for smaller integrated circuits. In particular, the surface area on the bottom of the integrated circuit, the side of the integrated circuit that mounts to a circuit board, for example, can be limited due to the need for surface mount leads, ball grid arrays, or the like. In some examples, a flat circular spiral inductor is included in the package for voltage regulation. The flat circular spiral inductor can require a large surface area on the package. Additionally, the flat circular spiral inductor can be limited to producing low inductance values and can be difficult to scale in larger integrated circuit packages. In some examples, inductor windings can be located on a plurality of copper layers within a substrate of the package. For instance, each winding can be located on a single layer of the substrate and connected to one or more adjacent windings by a via (i.e., an electronics trace inductor). This type of inductor can occupy one or more copper layers of the substrate and sometimes many layers in order to form a plurality of windings.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Electronic packages, such as Integrated Circuits (ICs) including Integrated Voltage Regulators (IVRs) include one or more inductors (e.g., a high frequency inductor). In some examples, the inductor can include an Air Core Inductor (ACI), such as a surface mount ACI, a planar spiral ACI, or an inductor including coils located on one or more layers of a substrate and interconnected by vias. In some examples, the ACI includes a dielectric core. For instance a dielectric core having the same or similar relative magnetic permeability as air (i.e., a magnetic permeability of about 1.0). Placing the ACI can be difficult in some electronic packages as a result of limited surface area on the placement side of the electronic package. For instance, Land Grid Array (LGA) or Ball Grid Array (BGA) contacts may require specific locations on the placement side (contact side) of the electronic package. Furthermore, signal routing (e.g., input and output signals, power, other electrical signals) may also be required on the placement side of the electronic package. In some electronic packages, there may be insufficient surface area on the placement side of the electronic package for the ACI. Moreover, ACIs can have low inductance values and are difficult to scale for packages including a die having a 14 nm feature size or less. For instance, an area available to construct the ACI within the substrate of the electronics package including a die having a 14 nm feature size can be reduced as compared to a corresponding area in an electronic package including a die of greater feature size (e.g., 22 nm or larger feature size).

The device and method discussed herein can include an inductor, such as a through-hole inductor, formed within a Plated Through-Hole (PTH) of a substrate or a substrate layer. A conductive layer (e.g., copper) within the PTH can be shaped into a helical structure by a coil cutting bit configured to produce the helical structure. In one or more examples, the through-hole inductor can be an ACI. Optionally, the through inductor can be filled with a material including magnetic particles suspended therein to form a Magnetic Core Inductor (MCI), such as a through-hole magnetic core inductor. The magnetic core can increase the inductance value of the through-hole inductor. In some examples, the MCI can include a magnetic core having a magnetic permeability including, 3, 5, 100, 200, or the like.

Figure 1:
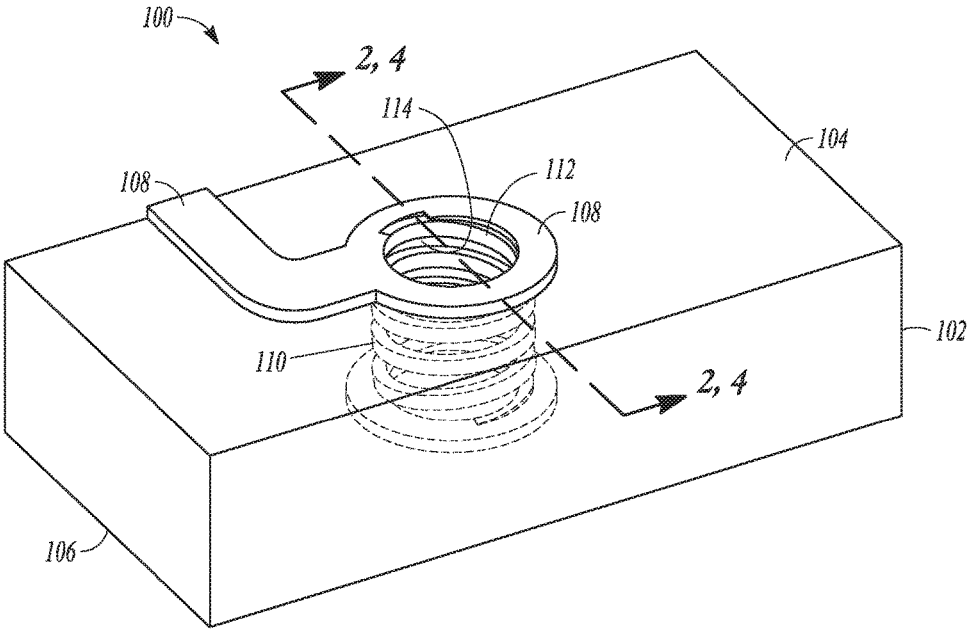
FIG. 1 is a perspective view of a through-hole inductor according to an example.

FIG. 1 shows a perspective view of a through-hole inductor 100 according to an example. The through-hole inductor 100 can include a dielectric layer 102. A first dielectric layer can include a first surface 104 and a second surface 106. The second surface 106 can be located on the opposing side of the first surface 104. An aperture 112 can be located within the dielectric layer 102, for instance to form a passage in the dielectric layer 102. The aperture 112 can be formed by any number of processes including, but not limited to, drilling, laser cutting, punching, etching, molding the aperture 112 into the dielectric layer 102, or the like. The aperture 112 can include an aperture wall 114 extended from the first surface 104 to the second surface 106 of the dielectric layer 102. In an example, the aperture can include a diameter of 100, 250, 400, 700, 1000 microns, or the like.

A conductive layer 108 can be deposited on the dielectric layer 102. For instance the conductive layer 108 can be deposited on all or a portion of the first surface 104, the second surface 106, and the aperture wall 114. For instance, the conductive layer can include a plated through-hole in the dielectric layer 102.

The dielectric layer 102 can include dielectric properties to prevent electrical conductivity between one or more conductive layers or components. In an example, the dielectric layer 102 can be substantially rigid, such as a printed circuit board. For instance, the material of the dielectric layer 102 can include glass-epoxy (e.g., FR-4, CEM-3, G-10, or other), Bismaleimide-Triazine epoxy, silica-filled epoxy, Cyanate Ester, Polyimide, Polytetrafluoroethylene (PTFE), Mylar (Biaxially-oriented polyethylene terephthalate), polyester film, polyethylene terephthalate (PET), beryllium oxide, aluminum, ceramic, porcelain, mica, glass, glass-cloth, prepreg, other metal oxides, other plastics, or the like. The thickness of the dielectric layer 102 can include, but is not limited to, 0.50 mm, 1.0 mm, 3.0 mm, 10.0 mm, or the like.

In an example, the dielectric layer 102 can include a flexible material, such a dielectric layer 102 of a flexible printed circuit. Optionally, a stiffener can support the flexible printed circuit for mechanical support. For instance, the stiffener can be located at, adjacent to, or around the location of the through-hole inductor 100. Mechanical support can reduce the risk of damage to the conductive layer 108. The flexible printed circuit materials can include polyester, polyethylene terephthalate (PET), polyimide (PI), polyethylene napthalate (PEN), Polyetherimide (PEI), fluoropolymers (e.g., FEP), copolymers, or the like. The thickness of the flexible printed circuit dielectric layer 102 can include 0.012 mm to 1.3 mm.

The conductive layer 108 can include, but is not limited to, leaded solder (tin/lead), lead free solder (tin/copper), Electroless Nickel Immersion Gold (ENIG)(nickel, copper, gold), soft gold, hard gold, immersion silver, immersion gold, immersion tin, conductive ink, or the like. In an example, the conductive layer 108 can be covered with an organic surface protectant to reduce oxidation. In an example, the conductive layer can include a Copper Clad Laminate (CCL). In an example, the conductive layer on the first surface 104 and the second surface 106 can include a rolled conductive material (e.g., copper) or an electroplated conductive material as previously described. In an example, the conductive layer 108 on the aperture wall 114 can include an electro-deposited or electroplated conductive material. The conductive layer 108 can include a total thickness including, but not limited to, 8.0-250.0 microns. In an example, the conductive layer can be 36 microns thick.

An example at least one coil 110 can be located on the aperture wall 114. As shown in the example of FIG. 1, the though-hole inductor 100 can include a plurality of coils 110, such as a plurality of coils 110 arranged in a helical shape. Each coil 110 can include one or more revolutions around the aperture 112. The helical shape can include a first end on the first surface 104 and a second end on the second surface 106. In an example, the aperture 112 can include two or more through-hole inductors, 100 for instance, in a double-helix shape. In other words, the conductive layer 108 located on the first surface 104 can include two independent electronic circuits (e.g., a first circuit and a second circuit). The conductive layer 108 located on the second surface 106 can include respective portions of the first and second circuits of the conductive layer 108 located on the first surface. The first electronic circuit can include a first coil 110 encircling the aperture wall 114, for instance, in at least one revolution of the aperture 112 from the first circuit of the first surface 104 to the first circuit of the second surface 106. Likewise, the second electronic circuit can include a second coil 110 encircling the aperture wall 114, for instance, in at least one revolution of the aperture 112 from the second circuit of the first surface 104 to the second circuit of the second surface 106. The through-hole inductor 100 can be configured to include one or more coils 110 including one or more turns (e.g., revolutions) that occupy a relatively small amount of surface area (e.g., area on the first surface 104 or second surface 106) on the dielectric layer 102 as a result of the location of the coils 110 within the aperture 112. The helical shape of the one or more coils 110 can also generate higher inductance values than planar coils (e.g. coils that lie on a flat surface and revolve around a coil center with an increasing radius).

In an example, the coil 110 can be cut from the conductive layer 108 located on the aperture wall 114. An entire thickness of the conductive layer 108 can be removed (e.g., cut) from the aperture wall 114 to form the one or more coils 110. The coil 110 cut from the conductive layer 108 can be identifiable by marks left on the coil 110 by the cutting tool. These identifiable marks can include, but are not limited to, chatter marks, feed marks, residual stress marks, work hardening, phase transformation, micro cracks, hanging chips, surface roughness, or the like. The conductive layer 108 located on the first surface 104, the second surface 106, or both can include an entrance or exit feature at the beginning or end of the coil 110 where a cutting bit started or ended a cutting path to form the one or more coils 110.

Figure 2:
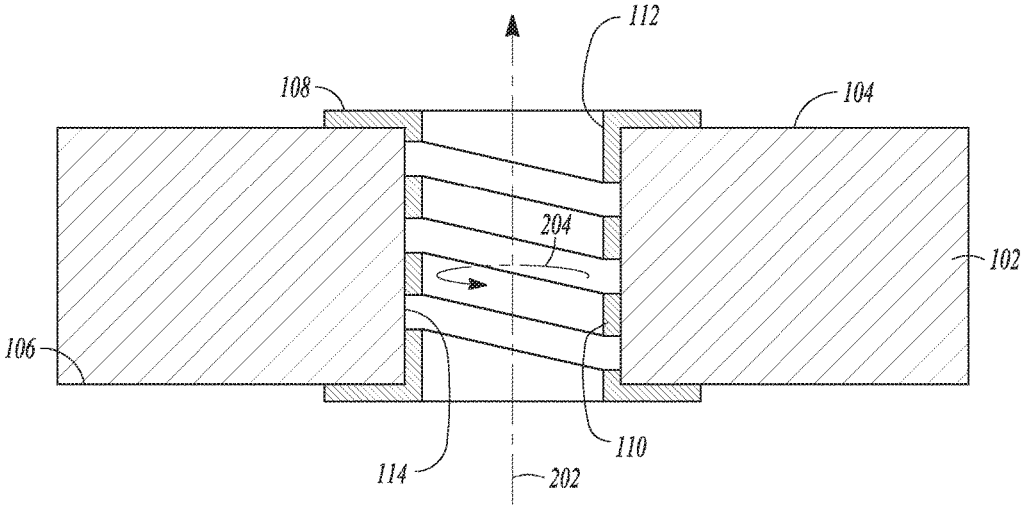
FIG. 2 is a cross section view of the through-hole inductor according to an example.

FIG. 2 depicts an exemplary cross section of the through-hole inductor 100 (located at 2-2 shown in FIG. 1). As previously discussed, the through-hole inductor 100 includes the dielectric layer 102. The conductive layer 108 is shown on the top surface 104, the bottom surface 106, and on the aperture wall 114. The conductive layer 108 is shown as a solid layer in FIG. 2 for the purposes of illustration. The conductive layer 108 can be etched (or otherwise arranged) into a more complex layout design in other examples.

One or more coils 110 can be located on the aperture wall 114. For instance, the one or more coils 110 can encircle the aperture wall from the conductive layer 108 on the first surface 104 to the conductive layer 108 on the second surface 106 in at least one revolution of the aperture 108. The one or more coils 110 can be cut from the conductive layer 108 located on the aperture wall 114. The example of FIG. 2 shows at least two revolutions of the coil 110 located along the aperture wall 114. In an example, the coil 110 can include, but is not limited to, a helical shape. For instance, the coil 110 can include a continuous helical shape extended from either the first surface 104 or the second surface 106 or from the first surface 104 to the second surface 106. The helical shape can include, but is not limited to, a pitch of 100, 160, 220, 260, 300, 400, 600 μm, or the like. The coil 110 can include a width including, but not limited to, 50, 100, 150, 200, 400 μm, or other width. In an example, the coil 110 can include a shape with a non-uniform pitch from the first surface 104 to the second surface 106. For instance, a first coil 110 can be located partially around the aperture wall 114 at a first distance from the first surface 104. A second coil 110 can be connected to the first coil 110. The second coil 110 can include a second distance from the first surface 104. In an example, the through-hole inductor 100 can include a plurality of coils 110, each including a distance from the first surface 104 that is staggered from an adjacent coil 110. Stated another way, the one or more coils 110 can be arranged in a step-wise progression extended from at least the first surface 104, the second surface 106, or both.

The coil 110 can be configured to generate an electromagnetic flux as a result of a current flowing through the one or more coils 110 of the through-hole inductor 100. For instance, the through-hole inductor 100 can include an Air Core Inductor (ACI). In some examples, the through-hole inductor 100 can be incorporated into a buck converter, voltage regulator, Integrated Voltage Regulator (IVR), radio frequency filter, phased-locked looped (PLL) filter, or the like. For instance, the through-hole inductor 100 can include an input voltage and an input current. An output voltage of the through-hole inductor 100 can be maintained within a range of output voltages. For instance, the output voltage of the through-hole inductors can be less than 0.9 volts, 1.8 volts, or other threshold voltage. The output current can fluctuate according to the demand of the circuit. In an example, the output current can increase, decrease, or remain constant according to a feedback loop within the circuit. A current 204 flowing through the one or more coils 110 can generate an electromagnetic flux 202 in a direction perpendicular to the one or more coils 110. In an example, the though-hole inductor 100 can include a Quality Factor (Q-factor) of 5, 8, 10 or greater (at 100 MHz). In an example, the through-hole inductor 100 can include inductance values (AC) of 1, 2, 3, 5, 7 nanohenry, or the like.

Figure 3:
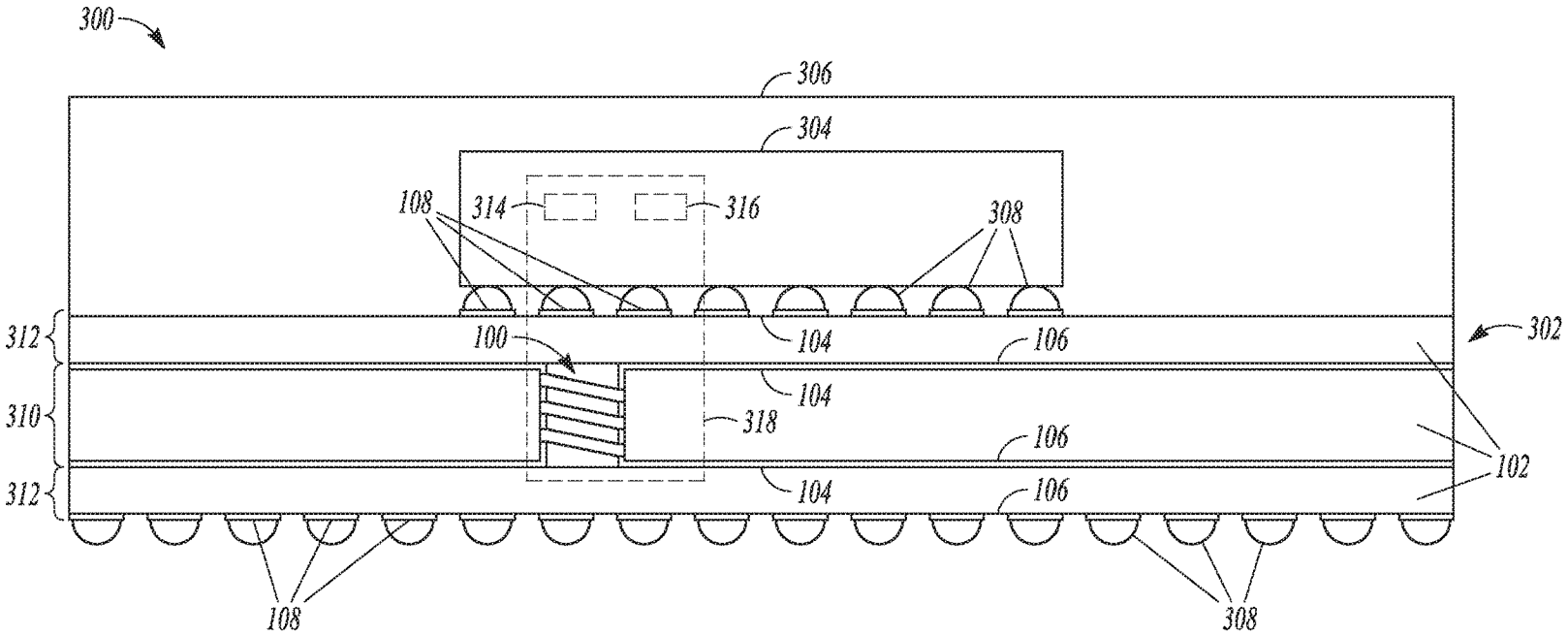
FIG. 3 is a perspective cross section view of an exemplary electronic package including a through-hole inductor within a substrate including a plurality of electrical contacts.
Figure 7:
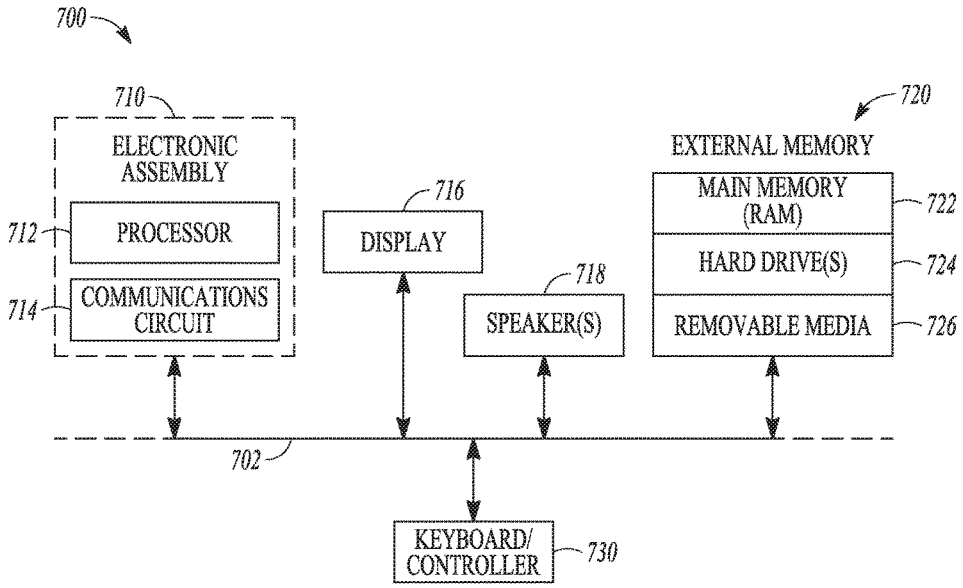
FIG. 7 is a diagram of an exemplary electronic device including the through-hole inductor.

FIG. 3 depicts an example of an electronic package 300, such as an electronic package 300 including the through-hole inductor 100. The electronic package 300 can include, but is not limited to, a processor, microprocessor, memory module, radio-frequency circuit, radio-frequency filter, PLL filter, other type of filter, or the like. In an example, the electronic package 300 can include an IVR 318. The IVR 318 can include the through-hole inductor 100. In an example, the IVR 318 can include a buck converter or other type of voltage regulator with an inductive component, such as the through-hole inductor 100. Locating the inductive component within the electronic package 300, can among other things, improve the power efficiency, reduce the size, reduce the cost, mitigate voltage ripple of the electronic package 300, or any combination thereof. In an example, the electronic package 300 can be included in an electronic device (as shown in FIG. 7 and described herein), such as a computer, mobile phone, radio, game counsel, or other electronic device. The electronic package 300 can be coupled to the electronic device. For instance, the electronic package 300 can include a substrate 302. The substrate 302 can include one or more electrical contacts 308 in electrical communication with a circuit board of the electronic device.

In the example shown in FIG. 3, the substrate 302 can include one or more substrate layers, such as a first substrate layer 310 and one or more secondary substrate layers 312. Each substrate layer can include a dielectric layer 102. As previously described, the dielectric layer 102 can include the first surface 104 and the second surface 106. Each substrate layer 310,312 can include at least one conductive layer 108 on the first surface 104, second surface 106, or both. Optionally, the substrate 302 can include a plurality of substrate layers, such as 2, 4, 6, 8, or more substrate layers. An example of the substrate 302 including three substrate layers (e.g., a first substrate layer 310 and two secondary substrate layers 312) is shown in FIG. 3. In an example, the substrate 302 can include a sequential layer build-up construction. For instance, the first substrate layer 310 can be a substrate core. The substrate core can include materials including, but are not limited to, glass-cloth, prepreg (resin impregnated fiberglass), or the like. One or more substrate layers can be laminated on one or both sides of the substrate core (e.g., a sequential layer build-up). In an example, the first substrate layer 310, the second substrate layer 312, or any substrate layer can include, but is not limited to, the substrate materials previously described herein. The first substrate layer 310 can include at least one through-hole inductor 100. The one or more second substrate layers 310 (e.g., build-up layers) can be located subjacent or superjacent to the first substrate layer 310. At least one of the secondary substrate layers 312 can include one or more electrical contacts 308, such as an exposed conductive pad of the conductive layer 108 or an electrical contact 308 placed on the conductive layer 108. In an example, one of the secondary substrate layers 312 (e.g., including the electrical contacts 308) can be referred to as a bottom build-up layer. The electrical contacts 308 can include any type of electrical contact including, but not limited to, a Ball Grid Array (BGA), Land Grid Array (LGA), Pin Grid Array (PGA), surface mount, through-hole, or the like. The through-hole inductor 100 can be located on a single substrate layer, such as within the substrate core or other substrate layer. For instance, one or more coils 110 can encircle the aperture 112 in at least one revolution within the thickness of a single substrate layer. In an example, one or more coils 110 can encircle the aperture 112 in a plurality of revolutions within the thickness of a single substrate layer. In an example, the through-hole inductor 100 can include a plurality of coils 110. Each coil 110 can include an equal diameter and can be aligned along the axis of the aperture 112 and aperture wall 114 (e.g., in a helical shape). Arranging the coils 110 to encircle a common cylindrical axis can increase the inductance value of the through-hole inductor 100, for instance, by increasing the number of turns of the coil 110 and accordingly the amount of electromagnetic flux generated.

The electrics package 300 can include a die 304. The die 304 can include a circuit, such as an integrated circuit. In an example, the die 304 can be fabricated from a silicon wafer, gallium arsenide, or other semiconductor. The die 304 can include, but is not limited to, a processor, microprocessor, random access memory, radio, arithmetic unit, any combination thereof, or the like. The die 304 can be in electrical communication with one or more conductive lavers 108 via an electrical connection with one or more conductive layers 108. The electrical connection can include, but is not limited to, Ball Grid Array (BGA), Land Grid Array (LGA), Pin Grid Array (PGA), wire bonding, surface mount, through-hole, or other type of connection. In an example, the die 304 can include a controlled collapse chip connection (e.g., a flip clip constriction). The die 304 can be in electrical communication with the electronic device via one or more conductive layers 108. For instance, the die 304 can be electronically coupled to the electronic device by one or more electrical contacts 308. In an example, one or more components of the IVR, such as IVR 318 can be located on the die 304. For instance, at least one capacitor 316 or resistor 314 of the IVR 318 can be located on the die 304. The through—hole inductor 100 can be located in the substrate 302. Locating some of the components of the IVR 318 on the die 304 can reduce the size of the electronic package 300 or the electronic device (described further herein), for example, a motherboard within the electronics device. In an example, the electronic package can include a cover 306. The cover 306 can encapsulate the die 304 and the tope surface 104 of the substrate 302 as shown in FIG. 3. The cover 306 can include an overmold or encapsulant material that includes, but is not limited to, a thermoset, epoxy, thermoplastic, polymer, or the like.

In an example, the through-hole inductor 100 can be located on a substrate layer that is superjacent to the bottom build-up layer (e.g., the bottom secondary layer 312 as shown in FIG. 3) as previously described. For instance, the through-hole inductor 100 can be located on the first substrate layer 310, such as the substrate core. Where the substrate 302 includes one or more layers, such as a sequential layer build-up, the location of the through-hole inductor 100 avoids interfering with trace routing on the conductive layers 108 located within the build-up. For instance, the through-hole inductor 100 can be located within the substrate core, and accordingly, the build-up (e.g., secondary layers 312) can include a greater area for trace routing. In an example, locating the though-hole inductor 100 on the first substrate layer 310 avoids routing difficulties around components that require a specific position on the substrate 302, such as BGA or LGA contacts. The location of the through-hole inductor 100 can also avoid input-output (TO) routing and/or placement of decoupling components (e.g., capacitors and/or resistors).

Figure 4:
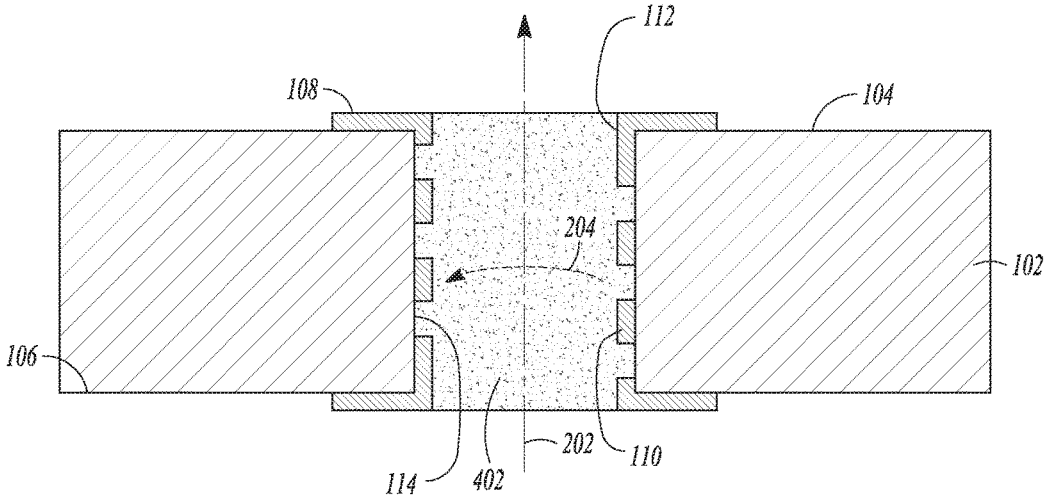
FIG. 4 is an example of the through-hole inductor including a magnetic core located within an aperture of the through-hole inductor.

FIG. 4 is a cross section of a through-hole inductor 400 including an inductor core, such as a magnetic core 402. The magnetic core can be located within the aperture 112. In an example, the magnetic core 402 can include magnetic particles suspended or dispersed within a carrier material. The magnetic core 402 can be applied during the manufacture of the substrate 302. The magnetic particles can include, but are not limited to, a material such as iron powder, manganese-zinc ferrite, molybdenum permalloy powder, nickel-zinc ferrite, sendust, silicon steel, or the like. In an example, the magnetic core 402 can include magnetic nanoparticles. The magnetic core 402 can include a magnetic permeability of 3, 5, 100, 200, or the like. The magnetic core 402 can increase the inductance values of the through-hole inductor 100. In an example, the magnetic core 402 can surround a portion of the one or more coils 110. For instance, where the magnetic core 402 is located between the one or more coils 110, the reluctance to the electromagnetic field surrounding the coil 110 is reduced. Accordingly, the electromagnetic flux 202 can be increased. In other words, the magnetic core 402 includes a lower reluctance to the electromagnetic field than the substrate 302 or air gap. In an example, the magnetic core 402 can include a slug of material. For instance, the slug of material can be inserted into the aperture 112.

Figure 5:
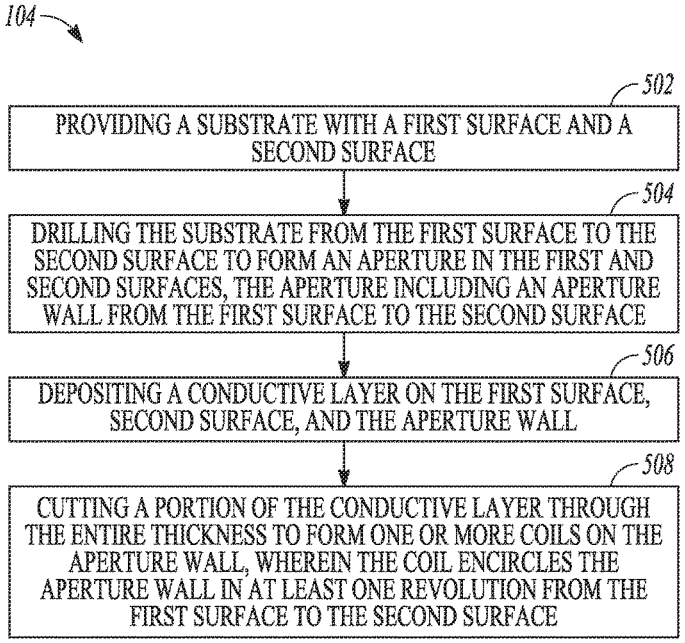
FIG. 5 is a diagram of a method of making the through-hole inductor according to an example.

FIG. 5 shows a diagram of an exemplary technique 500 for making the through-hole inductor 100 previously described herein and shown for instance in FIGS. 1-4. In describing the technique 500, reference is made to one or more components, features, functions, and steps previously described herein. Where convenient, reference is made to the components, features, steps and the like with reference numerals. Reference numerals provided are exemplary and are nonexclusive. For instance, features, components, functions, steps, and the like described in the technique 500 include, but are not limited to, the corresponding numbered elements provided herein. Other corresponding features described herein (both numbered and unnumbered) as well as their equivalents are also considered.

At 502, a dielectric layer 102 can be provided with a first surface 104 and a second surface 106 as previously described herein. For instance, the first surface 104 and the second surface 106 can be located on opposing sides of the dielectric layer 102. In an example, the dielectric layer 102 can include a substrate core, such as a glass-cloth core, prepreg core, or the like. The core can include a thickness including, but not limited to, 100, 400, 700, 1000 microns or the like.

At 504, the dielectric layer 102 can be drilled from the first surface 104 to the second surface 106 to form an aperture 112 in the first surface 104 and the second surface 106. The aperture 112 can include an aperture wall 114 from the first surface 104 to the second surface 106. In an example, the aperture 112 can be drilled with a drill bit including, but not limited to, a high-speed dill bit, high-speed steel drill bit, carbide drill bit, tungsten carbide drill bit, polycrystalline diamond drill bit, or the like. In an example, an automated drilling machine can perform the drilling operation. The automated drilling machine can include a processor with instructions thereon for drilling one or more apertures 112 at one or more locations within the dielectric layer 102. In some examples, the aperture 112 can be drilled by a laser, formed by a punch, or molded into the dielectric layer 102, or other aperture forming process.

At 506, a conductive layer 108 can be deposited on the first surface 104, second surface 106, and the aperture wall 114. For instance, the conductive layer 108 can be deposited by an electroplating process. The conductive layer 108 can include, but is not limited to, leaded solder (tin/lead), lead free solder (tin/copper), Electroless Nickel Immersion Gold (ENIG)(nickel, copper, gold), soft gold, hard gold, immersion silver, immersion gold, immersion tin, conductive ink, or the like. In an example, the conductive layer 108 can be covered with an organic surface protectant to reduce oxidation.

At 508, a portion of the conductive layer 108 can be cut through the entire thickness of the conductive layer 108 to form one or more coils 110 on the aperture wall 114. Stated another way, the conductive layer 108 can be removed from the aperture wall 114 to form at least one coil 110. The coil 110 can encircle the aperture wall 114 in at least one revolution from the first surface 104 to the second surface 106. In the example, of FIGS. 1-4 the coils 110 can include a helical shape. A coil cutting bit can be used to cut (i.e., remove) the conductive layer 108 from the aperture wall 114. Cutting the portion of the conductive layer 108 on the aperture wall 114 with the coil cutting bit can include rotating and translating the coil cutting bit in a sequence along a path from the first surface 104 to the second surface 106 thereby removing the conductive layer 108 on the aperture wall 114. Cutting the portion of the conductive layer 108 can further include rotating and translating the coil cutting bit in a reverse sequence along the path to withdrawal the coil cutting bit from the aperture 112. For instance, the sequence can include a helical path, such as to form coils 110 including the helical shape. Other shapes are also possible, for instance, a first coil can be substantially parallel with the first surface 104 or second surface 106 and including a step at the start and/or the end of the first coil to connect with one or more adjacent coils 110.

In an example, the coil cutting bit can be configured to produce the shape of the coil 110. The coil cutting bit can include, but is not limited to, a twist bit or other configuration of drill bit. In an example, the coil cutting bit can include a bit with one or more teeth having a larger diameter than the shank of the coil cutting bit. For instance, the teeth can have a diameter equal to or exceeding the diameter of the aperture 112. The shank of the coil cutting bit can be equal to or less than the diameter of the copper layer 108 located on the aperture wall 114. In an example, the coil cutting bit can include a geometry that matches the shape of the coil 110. As previously discussed with regards to the drill bit used to form the aperture 112, the coil cutting bit can include, but is not limited to, a high-speed dill bit, high-speed steel drill bit, carbide drill bit, tungsten carbide drill bit, polycrystalline diamond drill bit, or the like. In an example, the automated drilling machine can perform the drilling operation. The automated drilling machine can include a processor with instructions thereon for cutting a portion of the conductive layer 108 on the one or more aperture walls 114 to form one or more coils 110 on the aperture wall 114. In an example, the automated drilling machine can be programmed to rotate and translate the one or more cutting edges of the coil cutting bit in the sequence along the path from the first surface 104 to the second surface 106 thereby removing the conductive layer 108 on the aperture wall 114. The automated drilling machine can be programmed to rotate and translate the coil cutting bit in the reverse sequence along the path to withdrawal the coil cutting bit from the aperture 112. In an example, the coil 110 cut from the conductive layer 108 can be identifiable by marks left on the coil 110 by the coil cutting tool. These identifiable marks can include, but are not limited to, chatter marks, feed marks, residual stress marks, work hardening, phase transformation, micro cracks, hanging chips, surface roughness, or the like.

In an example, the technique 500 can further include locating a magnetic core 402 within the aperture 112. The magnetic core 402 can be deposited within the aperture 112. For instance, the magnetic core 402 can include magnetic particles suspended within a carrier, including but not limited to, a flux, polymer, epoxy material, or the like. For instance, the magnetic particles can include, but are not limited to, a material such as iron powder, manganese-zinc ferrite, molybdenum permalloy powder, nickel-zinc ferrite, sendust, silicon steel, or the like. In an example, the magnetic core 402 can include magnetic nanoparticles. The magnetic core 402 can be applied to the substrate layer and into the aperture 112 by injecting the magnetic core 402 from a nozzle (e.g., an inkjet printing head) or spreading the material of the magnetic core 402 (e.g., with a squeegee) over a stencil with an opening over the aperture 112. In an example, the magnetic core 402 can include a solid slug of material, such as ferrite, manganese-zinc ferrite, molybdenum permalloy, nickel-zinc ferrite, silicon steel, or the like. The slug can be inserted into the aperture 112 by a pick and place machine or by hand in some examples.

In an example, a second substrate layer (e.g., second substrate layer 312) can be coupled to (e.g., applied to) the first substrate layer 310. For instance, a secondary dielectric layer can be laminated over the conductive layer 108 located on the first surface 104 or the second surface of the first dielectric layer 102. An additional conductive layer 108 can then be electro-deposited over the secondary dielectric layer, forming a secondary substrate layer 312. The conductive layer 108 can be etched to form a pattern of traces therein, for instance, into an electrical circuit layout design. In an example, the one or more secondary substrate layers 312 can be laminated symmetrically on either side of the first substrate layer 310 (e.g., the core). In other words, a build-up can be formed on the core using the sequential layer build-up process.

In an example, the through-hole inductor 100 can be located on the first substrate layer 310. For instance, the dielectric layer 102 of the first substrate layer 310 is drilled and the second substrate layer 312 does not include a though-hole inductor 100. In an example, where the first substrate layer 310 includes the core, the core can be drilled and the through-hole inductor 100 can be formed therein. The second substrate layer 312 can be laminated on the first substrate layer 310, such as bonded to the first substrate layer 310 by one or more of pressure, heat, adhesive, or other lamination or additive process. The one or more conductive layers 108 on either side of the second substrate layer 312 can include signal traces (e.g., printed circuits). In an example, the second or subsequent layers can be a build-up or a bumpless build-up construction. The technique 500 can further comprise attaching at least one electrical contact 308 to the substrate 302. For instance, the electrical contact can be located on the placement side of the electronic package 300. The electrical contact 308 can be in electrical communication with at least one through-hole inductor 100.

The through-hole inductor 100 resulting from the technique 500 can be operative to generate electromagnetic flux through the aperture 112 in response to the application of a voltage differential between the conductive layer 108 located on the first surface 104 and the conductive layer 108 located on the second surface. In other words, the through-hole inductor 100 can generate an electromagnetic flux through the aperture 112 in response to a voltage differential across the one or more coils 110. The technique 500 can further include incorporating the through-hole inductor 100 in an electrical circuit, such as an electrical circuit configured as a IVR, a switching power regulator, a processor, microprocessor, memory module, radio-frequency circuit, radio-frequency filter, PLL filter, other type of filter, or the like.

Figure 6:
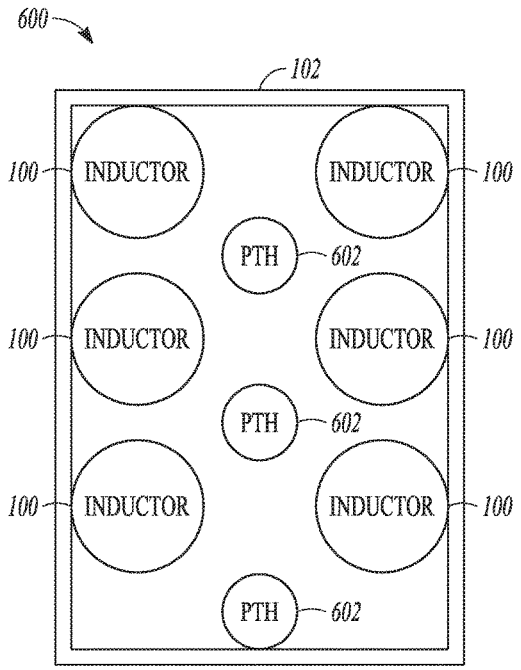
FIG. 6 shows an exemplary layout of a plurality of through-hole inductors included in an electronic package.

FIG. 6 depicts an exemplary layout 600 of a plurality of through-hole inductors 100 on a substrate 302. In the example shown in FIG. 6, the substrate 302 can include six or more through-hole inductors 100. The through-hole inductors 100 can be located within the keep-in zones of the substrate 302 to avoid thin walls along the edges of the substrate 302 and possible damage during depanelization. In the example, of FIG. 6, the though-hole inductors 100 can include an aperture 112 having a diameter of 250 microns. Three or more plated though-holes 602 can be included in the substrate 302. The plated though-holes 602 can be located between the though-hole inductors 100, for instance, to maximize the thickness of substrate 302 between each of the plated through-holes 602 and the though-hole inductors 100. In an example, the plated though-holes 602 can be vias connecting one or more conductive layers 108. The layout 600 allows for more area to place input voltage (Vin) decoupling capacitors on the electronic package 300. For instance, the through-hole inductors 100 can be located in the first substrate layer 310 and accordingly, decoupling components can be placed on the second substrate layer 312 or other substrate layers. As a result of the location of the though-hole inductor 100 within the first substrate layer 310, the number of additional substrate layers (e.g., layers of the sequential layer build-up) can be reduced. In an example, the second substrate layer 312 can include power distribution components or traces instead of one or more inductors.

An example of an electronic device (e.g., electronic system) using the through-hole inductor 100 and/or the electronic package 300 as described in the present disclosure is included to show an example of a higher level device application for the present invention. FIG. 7 is a block diagram of an electronic device 700 incorporating at least one through-hold inductor 100 and/or method in accordance with at least one embodiment of the invention. Electronic device 700 is merely one example of an electronic system in which embodiments of the present invention can be used. Examples of electronic devices 700 include, but are not limited to personal computers, tablet computers, mobile telephones, game devices, MP3 or other digital music players, etc. In this example, electronic device 700 comprises a data processing system that includes a system bus 702 to couple the various components of the system. System bus 702 provides communications links among the various components of the electronic device 700 and can be implemented as a single bus, as a combination of busses, or in any other suitable manner.

An electronic assembly 710 is coupled to system bus 702. The electronic assembly 710 can include any circuit or combination of circuits. In one embodiment, the electronic assembly 710 includes a processor 712 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that can be included in electronic assembly 710 are a custom circuit, an application-specific integrated circuit (ASIC), or the like, such as, for example, one or more circuits (such as a communications circuit 714) for use in wireless devices like mobile telephones, personal data assistants, portable computers, two-way radios, and similar electronic systems. The IC can perform any other type of function.

The electronic device 700 can also include an external memory 720, which in turn can include one or more memory elements suitable to the particular application, such as a main memory 722 in the form of random access memory (RAM), one or more hard drives 724, and/or one or more drives that handle removable media 726 such as compact disks (CD), flash memory cards, digital video disk (DVD), and the like.

The electronic device 700 can also include a display device 716, one or more speakers 718, and a keyboard and/or controller 730, which can include a mouse, trackball, touch screen, voice-recognition device, or any other device that permits a system user to input information into and receive information from the electronic device 700.

Each of these non-limiting examples can stand on its own, or can be combined in various permutations or combinations with one or more of the other examples. To better illustrate the method and apparatuses disclosed herein, a non-limiting list of embodiments is provided here:

Example 1 can include a though-hole inductor for an electronic package including, a substrate including at least one substrate layer, each substrate layer including a dielectric layer having a first surface and a second surface opposing the first surface. The through-hole inductor of example 1 can further include an aperture in at least one dielectric layer located from the first surface to the second surface, the aperture including an aperture wall from the first surface to the second surface. The through-hole inductor of example 1 can further include a conductive layer deposited on the first surface, second surface, and the aperture wall. The through-hole inductor of example 1 can further include at least one coil cut from the conductive layer, the at least one coil located on the aperture wall.

Example 2 includes the through-hole inductor of claim 1, wherein the at least one coil includes a helical shape.

Example 3 includes the through-hole inductor of any one of examples 1-2, further including a magnetic core within the aperture.

Example 4 includes the through-hole inductor of any one of examples 1-3, wherein the magnetic core includes magnetic particles suspended in a carrier.

Example 5 includes the through-hole inductor of any one of examples 1-4, wherein the substrate includes a second substrate layer including at least one electrical contact, the electrical contact configured for electrical communication.

Example 6 includes the through-hole inductor of any one of examples 1-5, wherein the substrate includes a substrate core and at least one secondary substrate layer includes a sequential layer build-up.

Example 7 includes a method of making a through-hole inductor Including providing a dielectric layer with a first surface and a second surface, drilling the dielectric layer from the first surface to the second surface to form an aperture in the first and second surfaces, the aperture including an aperture wall from the first surface to the second surface, depositing a conductive layer on the first surface, second surface, and the aperture wall, and cutting a portion of the conductive layer through the entire thickness to form one or more coils on the aperture wall, wherein the coil encircles the aperture wall in at least one revolution from the first surface to the second surface.

Example 8 includes the method of example 7, wherein cutting a portion of the conductive layer on the aperture wall includes removing the conductive layer with a coil cutting bit.

Example 9 includes the method of any one of examples 7-8, wherein cutting the portion of the conductive layer on the aperture wall with the coil cutting bit includes, rotating and translating the coil cutting bit in a sequence along a path from the first surface to the second surface thereby removing the conductive layer on the aperture wall, and rotating and translating the coil cutting bit in a reverse sequence along the path to withdrawal the coil cutting bit from the aperture.

Example 10 includes the method of any one of examples 7-9, wherein the sequence includes a helical path.

Example 11 includes the method of any one of examples 7-10, further comprising locating a magnetic core within the aperture.

Example 12 includes the method of any one of examples 7-11, wherein locating the magnetic core within the aperture includes depositing, within the aperture, magnetic particles suspended in a carrier.

Example 13 includes the method of any one of examples 7-12, wherein providing the dielectric layer includes providing a substrate core.

Example 14 includes an electronic package including a though-hole inductor including a substrate including at least one substrate layer, each substrate layer including a dielectric layer having a first surface and a second surface, an aperture in the dielectric layer located from the first surface to the second surface, the aperture including an aperture wall extended from the first surface to the second surface, a conductive layer deposited on the first surface, second surface, and the aperture wall, and at least one coil cut from the conductive layer, the at least one coil includes a helical shape located on the aperture wall from the first surface to the second surface, wherein the at least one coil is configured to generate an electro-magnetic flux.

Example 15 includes the electronic package of example 14, wherein the electronic package includes an integrated voltage regulator.

Example 16 includes the electronic package of any one of examples 14-15, further comprising a magnetic core disposed within the aperture.

Example 17 includes the electronic package of any one of examples 14-17, wherein the magnetic core includes magnetic particles suspended within a carrier.

Example 18 includes the electronic package of any one of examples 1-17, wherein the magnetic core includes magnetic nanoparticles.

Example 19 includes the electronic package of any one of examples 14-18, wherein the substrate includes a second substrate layer, the second substrate layer can include a secondary conductive layer, the secondary conductive layer includes at least one electrical contact configured for electrical communication.

Example 20 includes the electronic package of any one of examples 14-19, wherein the substrate includes a substrate core and at least one second substrate layer includes a sequential layer build-up.

Example 21 includes the electronic package of any one of examples 14-20, further comprising a buck converter circuit, the buck converter circuit including at least a capacitor and a resistor located on a silicon die.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An electronic package including a through-hole inductor comprising:

a substrate including at least one substrate layer, each substrate layer including a dielectric layer having a first surface and a second surface;

an aperture in the dielectric layer located from the first surface to the second surface, the aperture including an aperture wall extended from the first surface to the second surface;

a conductive layer on the first surface, second surface, and the aperture wall;

a die coupled to the substrate and electrically coupled with the conductive layer; and an integrated voltage regulator (IVR) including:

at least one coil cut from the conductive layer, the at least one coil located on the aperture wall from the first surface to the second surface and on at least one of the first and second surface, wherein the at least one coil is configured to generate an electro-magnetic flux, a magnetic core disposed in physical contact with the aperture wall, the coil, and the dielectric layer between segments of the coil, and at least one capacitor or resistor located on the die.

2. The electronic package of claim 1, wherein the magnetic core includes magnetic particles suspended within a carrier, the magnetic core including flux, polymer, or epoxy material with magnetic particles suspended therein.

3. The electronic package of claim 2, wherein the magnetic core includes magnetic nanoparticles.

4. The electronic package of claim 1, wherein the substrate includes a second substrate layer, the second substrate layer can include a secondary conductive layer, the secondary conductive layer includes at least one electrical contact configured for electrical communication.

5. The electronic package of claim 4, wherein the substrate includes a substrate core and at least one second substrate layer includes a sequential layer build-up.

6. The electronic package of claim 1, wherein the IVR includes a buck converter circuit.

7. The electronic package of claim 1, wherein the at least one coil includes a helical shape.

8. The electronic package of claim 1, wherein the at least one coil is located within the substrate above or beneath the die.

9. The electronic package of claim 1, wherein the magnetic core is disposed on the aperture wall at a location above and below the coil along a longitudinal axis of the aperture.

* * * * *